US006273736B1

(12) United States Patent
Taylor et al.

(10) Patent No.: US 6,273,736 B1
(45) **Date of Patent: *Aug. 14, 2001**

(54) SAFETY GUARD FOR AN RF CONNECTOR

(75) Inventors: William N. Taylor, Dublin; Richard R. Mett, Santa Clara; Mark W. Curry, San Jose, all of CA (US)

(73) Assignee: Applied Materials, Inc., Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/898,178

(22) Filed: Jul. 22, 1997

(51) Int. Cl.[7] ..... H01R 13/44
(52) U.S. Cl. ..... 439/149; 439/63
(58) Field of Search ..... 439/149, 63, 581

(56) References Cited

U.S. PATENT DOCUMENTS 4,603,926 * 8/1986 Nesbit et al. ..... 439/63
4,741,703 * 5/1988 Johnescu et al. ..... 439/63
4,900,258 * 2/1990 Hnatuck et al. ..... 439/581
4,964,805 * 10/1990 Gabany ..... 439/63
5,703,324 * 12/1997 Harder ..... 439/578

OTHER PUBLICATIONS

Kings Electronics Co., Inc., Catalog 500–89, pp. 77–79, Jun. 1997.

* cited by examiner

*Primary Examiner*—Tulsidas Patel
(74) *Attorney, Agent, or Firm*—Hale and Dorr LLP

(57) ABSTRACT

The present invention provides a safety guard for a type-N coaxial connector that prevents casual human contact with a conductive center pin of the coaxial cable. The safety guard is preferably made of a dielectric material and is generally tubular in shape. The safety guard is adapted to be installed on existing connectors in the field, or to be part of a connector assembly that is to be installed on a coaxial cable. Among the advantages of the present invention are substantial reduction in complexity over prior art interlock connector designs. The safety guard of the present invention is provided for a male connector only, thereby alleviating the need for modification of the mating female connector.

28 Claims, 2 Drawing Sheets

SAFETY GUARD FOR AN RF CONNECTOR

FIELD OF THE INVENTION

The present invention relates to the field of electronic connectors. In particular, the present invention is directed to a safety guard for a type-N coaxial connector that prevents casual human contact with a center pin of the coaxial cable.

BACKGROUND OF THE INVENTION

Conventional coaxial connectors are typically manufactured with male connectors having a pin in the center of the connector. Recently, the Semiconductor Equipment Standards Organization promulgated a set of safety guidelines for the semiconductor industry entitled, "SEMI S2-93, Safety Guidelines for Semiconductor Manufacturing Equipment", published in 1994. One of the areas addressed by SEMI S2-93 relates to radio frequency (RF) equipment using greater than 30 volts root-mean-square (RMS) or 42.2 volts peak RF power. According to paragraph 5.4 of the guidelines, any equipment using greater than 30 volts RMS or 42.2 volts peak, as well as other specified equipment, should be provided with physical barriers or safety interlocks at the point of hazard to effectively protect persons from exposure to the hazards associated with the specified equipment. Additionally, according to SEMI S2-93, if the physical barrier does not require a tool to obtain access, the interlock solution is mandatory.

Most connector manufacturers have chosen to take the interlock approach in complying with the safety guidelines set forth in SEMI S-2-93 even in situations where the interlock solution is not required by the standard. Using an interlock arrangement requires substantial reconfiguration of the standard coaxial connector. Conventional interlock designs typically require modification of both the male and female connector ends to ensure proper mating of the connectors while providing the required safety guard. Interlock designs typically require substantial modifications to the system to include protective housings, microswitches, PCBs, cables and harnesses to accommodate the interlocks. Additionally, there are guard designs of various connector manufacturers that are single source/proprietary and require the use of a relatively expensive non-standard male and female connector mating set. By adopting an interlock solution or propriety guarded connectors, most manufacturers have unnecessarily increased the complexity and costs of providing coaxial connectors that meet the safety guidelines set forth in SEMI S2-93. What is needed is a simple and cost-effective solution that provides the safety features set forth in the standard, without requiring unnecessarily complex and expensive interlock and connector designs.

SUMMARY OF THE INVENTION

The present invention provides an improved connector design that meets the safety guidelines of SEMI S2-93 without requiring expensive and complex interlocking connectors that are not adaptable to conventional coaxial connectors. In particular, the present invention provides a guard for a type-N RF coaxial connector that may be inserted into an existing male coaxial cable connector, or which may be provided together with the connector assembly so that when the connector is installed, it will be provided with the appropriate safety guard. In addition to being easily retrofitted onto existing connectors, the safety guard of the present invention provides a simple and cost-effective solution for meeting the safety guidelines relating to RF connectors. Moreover, the present invention implements a safety guard that is used on the male connector only, thereby alleviating the additional expense incurred by modifying both the male and female connectors, as required by proprietary guarded connector designs.

In effect, the present invention provides an intrinsically safe RF coaxial connector that does not require an interlock structure, wherein an operator or user cannot reach the hazard, i.e., the conducting center pin of the coaxial cable, per Underwriters Laboratories Articulate Finger test as set forth in UL 507, thereby removing the point of hazard.

BRIEF DESCRIPTION OF THE DRAWINGS

The invention will be described in detail herein with reference to the following drawings, in which like reference numerals refer to like elements throughout the several views, and wherein.

DETAILED DESCRIPTION OF PREFERRED EMBODIMENTS

Figure 1:
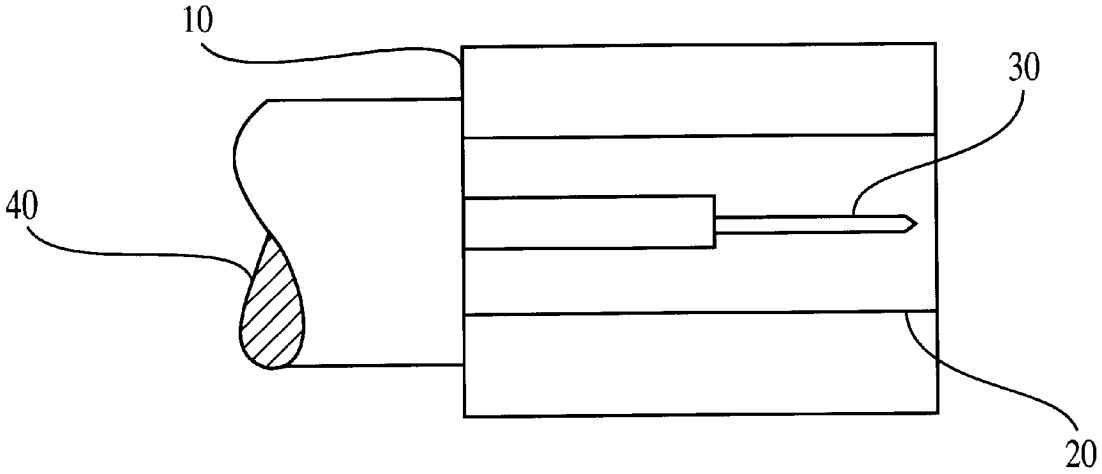
FIG. 1 PRIOR ART
FIG. 1 is a cross-sectional view of a conventional connector.

As shown in FIG. 1, a conventional type-N male connector includes a connector shell 10 that is typically grounded to a return shield 20 of the coaxial cable 40. Conventional coaxial cables typically have a conductive center wire surrounded by a dielectric material, which may, in turn, be optionally surrounded by a shielding material, typically conductive foil or braided wire. The conductive center wire and the surrounding dielectric are concentric and share a common longitudinal axis. The cable construction, thus described, is generally contained in an outer shell or cladding made of a plastic or rubberized material that protects the cable construction from weather, dirt, corrosion, and the like. The center pin 30, which is the powered portion of the cable 40 is an extension of the conductive center wire of the cable 40.

As in evident from FIG. 1, there is no guard that would prevent the powered center pin 30 of the coaxial cable 40 from coming into contact with an operator or user who may be handling the cable. Accordingly, the risk of contact with the powered center pin 30 is very high. In order to minimize the risk of exposure to the powered center pin 30, the semiconductor industry has generally accepted the recommendations contained in SEMI S2-93, as discussed above. Furthermore, as discussed above, most manufacturers have chosen to use complex and expensive interlock and connector designs to comply with the safety requirements of SEMI S2-93.

Figure 2:
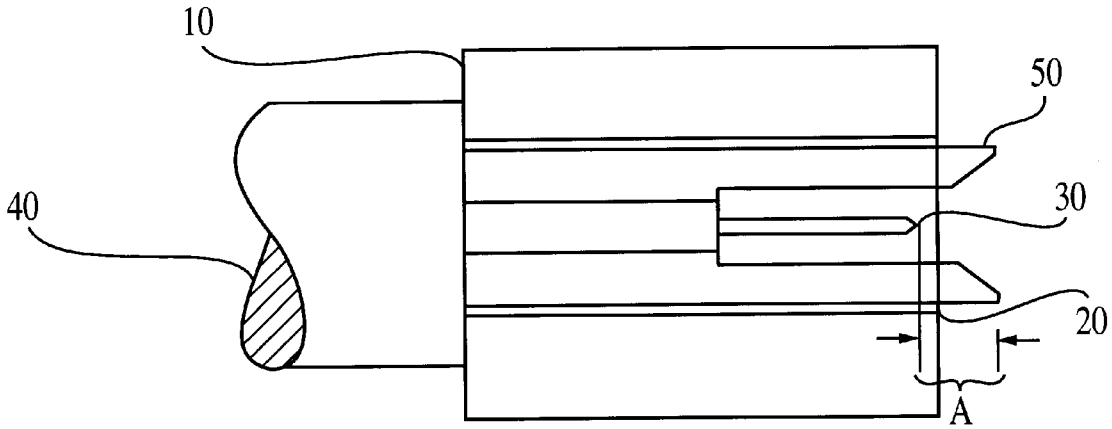
FIG. 2 is a cross-sectional view of a coaxial connector fitted with the safety guard of the present invention.

The inventors of the instant invention have discovered a much simpler and cost-effective solution to compliance with SEMI S2-93. Specifically, as shown in FIG. 2, an electrically insulating and protective safety guard 50 may be inserted in the connector 10 to surround the conductive powered center pin 30, such that the risk of exposure to, or human contact with, the powered center pin 30 is minimized, and the connector 10, thus equipped, is in compliance with SEMI S2-93. Additionally, by using a guard 50 that surrounds the center pin 30, no further modification to a female connector (not shown), to which the male connector 10 mates, is required. Moreover, the insulated safety guard 50 does not affect the RF function of the connector 10, nor does it affect the ability of the modified connector 10 to connect to its coaxial male (not shown). Additionally, the safety guard 50 may be installed in an unmodified existing connector, such as that shown in FIG. 1, in the field, or the safety guard 50 may be optionally included as part of the connector assembly such that when the cable is manufactured, it will be equipped with the safety guard 50.

Numerous considerations must be taken into account when determining the dimensions of the safety guard 50. In particular, care must be taken to ensure that the safety guard 50 does not interfere with proper mating of the connector 10 to its coaxial mate (not shown), while further ensuring that the safety objectives, for which the safety guard 50 is implemented, are, likewise, met. In order to be intrinsically safe, the operator or user should not be able to reach the hazard, i.e., the powered center pin 30, per Underwriters Laboratories (UL) Articulate Finger test, as set forth in publication UL 507, the disclosure of which is incorporated herein by reference in its entirety. The UL Articulate Finger test uses a probe (not shown) having predetermined dimensions. In order to meet the requirements of the UL 507 Articulate Finger test, the articulate probe must not be able to reach the hazard, which, in this case, is the powered center pin 30. By passing the UL 507 test, the point of hazard is said to be removed.

In order to determine the size of the protective guard 50, it must be determined how close to the center pin 30 the articulate probe, representative of a human finger, can get to the center pin 30, without danger of electric shock. To analyze this, the $P_{foldback}$ of a coaxial cable is used to calculate the arcing distance of the center pin 30, and thus, the dimensions of the safety guard 50. The arcing distance is also referred to as the standoff distance. The standoff distance may be determined if it is know what maximum power is being carried on the center pin 30. The maximum voltage on the center pin is determined by the RF power on the cable 40. If the cable 40 is disconnected, the generator (not shown) supplying power to the cable 40 goes into what is known in the art as a foldback condition within milliseconds of the cable 40 being disconnected from the generator. The foldback condition limits the power supplied to the cable 40. A typical value for this foldback limit has been found to be in the range of 300 watts. Once $P_{foldback}$ is known, the maximum voltage on the center pin 30 may be readily determined by performing the following calculation:

$$V_{maxRMS}:=2\sqrt{(P_{foldback}\times 50\Omega)} \quad (1)$$

Substituting 300 watts for $P_{foldback}$ into Equation (1) results in a $V_{maxRMS}$ of 245 volts. When $V_{maxRMS}$ is known, $V_{maxPEAK}$ is determined using the following equation:

$$V_{maxPEAK}:=\sqrt{2}\times V_{maxRMS} \quad (2)$$

Using the $V_{maxRMS}$ value obtained from Equation (1) and substituting this value into Equation (2), a value for $V_{maxPEAK}$ of 346 volts is obtained. Knowing the $V_{maxPEAK}$, the standoff distance is readily obtained using known mathematical techniques or readily available tables well known to those of ordinary skill in the art. For a $V_{maxPEAK}$ of 350 volts, a standoff distance is determined to be approximately 0.20 inches and is denoted by the distance A shown in FIG. 2. The standoff distance falls well within known parameters for air gap distance tolerance for a female coaxial connector, which is typically in the range of 0.2 to 0.25 inches.

It is preferred to provide the safety guard 50 with the connector assembly to ensure proper location of the safety guard 50 as well as durability and lowered risk of the safety guard 50 falling out of the connector 10. Additionally, ends of the safety guard 50 may be beveled, as shown graphically in FIG. 2 to promote ease of mating with the female connector. However, a flat end is equally effective in providing the requisite level of protection from the hazard of having the powered center pin 30 exposed such that it may be contacted by the operator. In addition, a portion of the guard that surrounds the center pin may have a greater inner diameter than another portion of the guard that surrounds an unexposed portion of the conductive center wire, as shown in FIG. 2. Any suitable dielectric material may be used to construct the safety guard 50. It has been found that a preferred material is polyteterafluorethylene (PTFE) commonly know under the trade name Teflon™, or polypropylene, which provide suitable durability and electrical characteristics required for the safety guard 50. However, it will be understood that any material that provides suitable electrical and endurance characteristics may be used.

Figure 3:
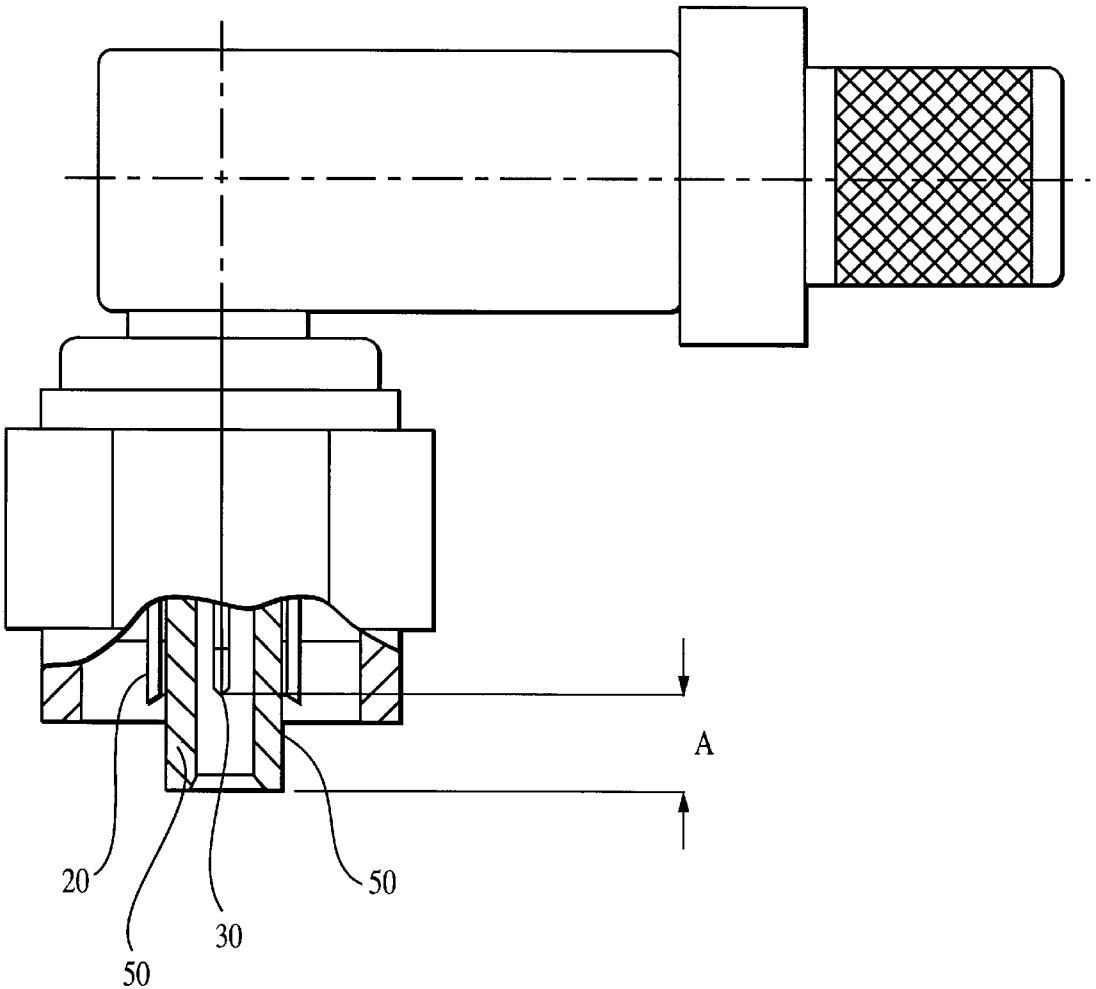
FIG. 3 is a diagram of a right-angled connector embodiment of the present invention.

This invention, thus described, alleviates the need for an end-lock or interlocking end guard for providing compliance with the safety guidelines of SEMI S2-93. Furthermore, the invention provides a cost-effective and simplified solution to providing coaxial connectors that comply with SEMI S2-93. It will be understood that the safety guard of the present invention is suitable for use in any number of connector configurations known to or being designed by those skilled in the art. One preferred construction is a right-angle connector shown in FIG. 3. Such a right angle connection is suitable in many electronic environments, such as, for example, the tight spaces of multi-chamber semiconductor process equipment, where a straight connector causes the cable to extend out from the chamber to encroach on the space allocated for adjacent chambers. Frequently, a right-angle adapter is used with the straight cable connector to prevent this encroachment, requiring both the cable connector and the right angle adapter to be interlocked to meet the requirements of SEMI S2-93. Use of a right angle connector that is guarded according to the present invention simplifies the cable installation and meets the requirements of SEMI S2-93 without the need for complex interlocks.

While the invention has been described in conjunction with specific embodiments thereof, it is evident that many alternatives, modifications and variations will be apparent to those skilled in the art. Accordingly, the preferred embodiments of the invention, as set forth herein, are intended to be illustrative, not limiting. Various changes may be made without departing from the true spirit and full scope of the invention, as defined in the following claims.

What is claimed is:

1. A coaxial connector comprising:

a conductive center pin;

a shield disposed around said conductor center pin; and an electrically insulating safety guard disposed between said conductive center pin and said shield, wherein a distance between an end of the conductive center pin and an end of the electrically insulating safety guard is at least a standoff distance, and wherein said standoff distance is greater than the distance between said end of the conductive center pin and an end portion of said shield closest to said end of the electrically insulating safety guard.

2. The connector of claim 1, wherein said electrically insulating safety guard is substantially tubular having a substantially circular cross section.

3. The connector of claim 2, wherein said conductive center pin, said shield, and said electrically insulating safety guard have a common longitudinal axis.

4. The connector of claim 2, wherein said electrically insulating safety guard comprises a first section and a second section, said first section having an inner diameter greater than said second section, said first section being disposed about an exposed portion of said conductive center pin.

5. The connector of claim 1, wherein the end of said electrically insulating safety guard is beveled.

6. The connector of claim 1, wherein said connector is a male coaxial connector.

7. The connector of claim 1, wherein said electrically insulating safety guard comprises a dielectric material.

8. The connector of claim 7, wherein said dielectric material comprises polytetrafluorethylene or polypropylene.

9. The connector of claim 1, wherein said standoff distance is based on a foldback voltage of said conductive center pin.

10. The connector of claim 1, wherein the standoff distance is greater than or equal to 0.20 inches.

11. The connector of claim 10, wherein the standoff distance is 0.2 to 0.25 inches.

12. The connector of claim 1, wherein the connector is a type-N coaxial connector.

13. The connector of claim 1, wherein the connector is a radio frequency connector.

14. The connector of claim 1, wherein the electrically insulating safety guard has been retrofitted onto the coaxial connector.

15. The connector of claim 1, wherein the conductive center pin has greater than 30 volts root-mean-square or greater than 42.2 volts peak.

16. The connector of claim 1, wherein the connector is a right-angle connector.

17. The connector of claim 1, wherein the safety guard satisfies a July 1997 UL 507 standard.

18. A coaxial connector comprising:

a conductive center pin;

a shield disposed around said conductive center pin; and an electrically insulating safety guard disposed between said conductive center pin and said shield, wherein said conductive center pin and said shield are an integral part of the coaxial connector, and wherein the electrically insulating safety guard is slidably attachable around said conductive center pin to the coaxial connector such that the safety guard can be retrofitted onto the coaxial connector, and wherein a distance between an end of the conductive center pin and an end of the electrically insulating safety guard is a predetermined distance.

19. The connector of claim 18, wherein said predetermined distance is greater than the distance between said end of the conductive center pin and an end portion of said shield closest to said end of the electrically insulating safety guard.

20. The connector of claim 18, wherein the end of said electrically insulating safety guard is beveled.

21. The connecor of claim 18, wherein said connector is a male coaxial connector.

22. The connector of claim 18, wherein said electrically insulating safety guard comprises a dielectric material.

23. The connecor of claim 22, wherein said dielectric material comprises polytetrafluoroethylene or polypropylene.

24. The connecor of claim 18, wherein said predetermined distance is based on a foldback voltage of said conductive center pin.

25. The connecor of claim 18, wherein said predetermined distance is greater than or equal to 0.20 inches.

26. The connector of claim 25, wherein the predetermined distance is 0.2 to 0.25 inches.

27. The connector of claim 18, wherein the conductive center pin has greater than 30 volts root-mean-square or greater than 42.2 volts peak.

28. The connector of claim 18, wherein the safety guard satisfies a July 1997 UL 507 standard.

* * * * *